United States Patent [19]

Wiethoff

[11] 4,404,748

[45] Sep. 20, 1983

[54] FOLDING KNIFE

[75] Inventor: Günter Wiethoff, Solingen, Fed. Rep. of Germany

[73] Assignee: Firma Cuno Melcher KG ME-Sportwaffen, Solingen, Fed. Rep. of Germany

[21] Appl. No.: 340,014

[22] Filed: Jan. 18, 1982

[30] Foreign Application Priority Data

Jan. 15, 1981 [DE] Fed. Rep. of Germany ..... 3101028
Sep. 12, 1981 [DE] Fed. Rep. of Germany ..... 3136325

[51] Int. Cl.[3] ..... B26B 1/00; B26B 29/00
[52] U.S. Cl. ..... 30/161
[58] Field of Search ..... 30/160, 161, 164, 143, 30/342, 159; 81/177 E

[56] References Cited

U.S. PATENT DOCUMENTS 3,942,249 3/1976 Poehlmann ..... 30/161 X
4,233,737 11/1980 Poehlmann ..... 30/161 X
4,272,887 6/1981 Poehlmann ..... 30/161

*Primary Examiner*—Robert C. Watson
*Assistant Examiner*—Douglas D. Watts
*Attorney, Agent, or Firm*—Karl F. Ross

[57] ABSTRACT

A folding knife has a handle with a body forming a pocket into which its blade is normally retracted, the pocket being bounded by two cheeks of the holder body traversed by respective contacts in line with a hole near an end of the blade. One cutout is occupied by a plunger which is rigidly connected with a detent, occupying the other cutout by a stem that is integral with either the plunger or the detent and traverses the hole of the blade to serve as its pivotal axle. A spring in the first cutout biases the interconnected plunger and detent into a locking position in which a projection on the detent engages in a notch of the blade to hold it in its retracted or its extended position; the biasing spring may bear directly on a confronting blade surface and coact with one of its notches to prevent a rapid switch into the extended position.

11 Claims, 11 Drawing Figures

12
21
32

15
19
17
23

12
19
27
14
39
17
15
21
23
22
13
25
20
33
31
26
28
18
16
30
24
11
29

18
16
26
33

FOLDING KNIFE

FIELD OF THE INVENTION

My present invention relates to a folding knife with a handle forming a pocket for the reception of a retracted blade pivotable into an extended position.

BACKGROUND OF THE INVENTION

It is known, e.g. from U.S. Pat. No. 4,170,061, to provide the handle of such a knife with a locking member which can be manually depressed against a spring force to release the blade from its retracted or extended position for allowing it to be swung about its pivotal axis. These known blades are of relatively complex structure including liners and bolsters for the guidance of the locking member and for the interconnection of the two halves of the handle body between which the blade-receiving pocket is formed.

OBJECTS OF THE INVENTION

An object of my present invention, therefore, is to provide a simplified construction for such a folding knife.

A more particular object is to provide means in such a knife for securely holding the blade in either of its limiting positions (and possibly also in an intermediate position) while controlling its pivotal swing to prevent its use as an offensive weapon similar to a switch blade.

SUMMARY OF THE INVENTION

The handle body of a knife according to my invention is integrally formed with substantially coextensive first and second cheeks that are separated by a pocket accommodating its blade in a retracted position, the blade being provided opposite its point with a blunt end having a circular hole. Aligned cutouts in the two cheeks extend from the pocket to the outer cheek surfaces in line with the hole of the blade. A first member lodged in one of these cutouts, referred to hereinafter as a plunger, is rigidly connected with a second member in the other cutout, referred to hereinafter as a detent, by a stem which forms part of one of these members and is of the same diameter as the hole of the blade traversed by this stem so that the blade can swing about the axis thereof. The two members are separated from each other by an axial distance which is sufficient to let them be jointly displaced along the axis of their bores between a normal and an off-normal position. The first member or plunger is engaged by spring means in its cutout biasing the interconnected members into their normal position; the second member or detent, which is nonrotatable about the pivotal axis, has a retaining formation engaging a coacting formation on the blunt end of the blade in both the retracted and the extended position thereof whereby axial depression of the plunger against the force of its spring means disengages these formations to enable a pivoting of the blade. Either or both cutouts may have the shape of a recess communicating with the pocket through a reduced bore whose diameter equals that of the blade hole.

Pursuant to a more particular feature of my invention, the spring means may comprise a resilient element—e.g. a coil spring—within the first cutout having an extremity which bears upon the blade and retards its pivotal displacement when the plunger is depressed. Such retardation can be enhanced by letting the spring extremity engage one of two notches which constitute the aforementioned coacting formation, this notch confronting the spring extremity in an intermediate blade position. The retaining formation engageable with these notches is advantageously designed as an off-axial projection of the detent which penetratess an aperture in the second cheek of the knife handle and normally reaches into its pocket, this projection also having the purpose of preventing any rotation of the detent in its cutout.

BRIEF DESCRIPTION OF THE DRAWING

The above and other features of my invention will now be described in detail with reference to the accompanying drawing in which.

SPECIFIC DESCRIPTION

Figure 1:
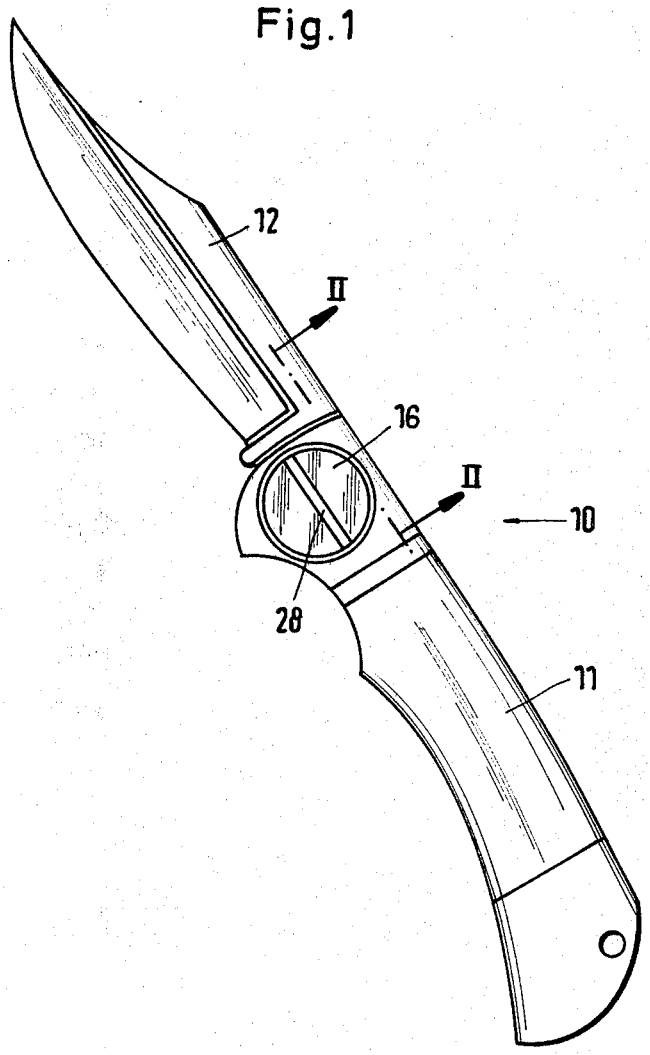
FIG. 1 is a side view of my improved folding knife shown with its blade extended.

Reference will first be made to FIGS. 1–5 showing a simple embodiment of my invention, i.e. a folding knife 10 having a handle 11 and a blade 12 ending in a point. Handle 11 has an integral body with two cheeks 22 and 24 separated by a pocket 13 which is closed along the right-hand longitudinal edge of the handle as seen in FIG. 1, blade 12 being provided at its blunt end with a circular hole 32 centered on a pivotal axis O. Cheek 22 has a throughgoing cutout 27 of constant cross-section, much larger than hole 32; cheek 24 has a cutout formed by a recess 25 which opens onto the outer cheek surface and communicates with the pocket 13 via a bore 20 coaxial with and of the same diameter as hole 32. Cutout 27 accommodates a detent 15 shown in FIG. 4 to have flat parallel sides closely fitting between the walls of that cutout to prevent relative rotation of member 15 about axis O. A threaded axial stud 17 of detent 15 is screwed into a complementarily threaded bore 18 of a stem 26 which is rigid with a circular head 33 of a plunger 16 received in recess 25. Head 33 is formed with an arcuately curved slot 28 engageable by a coin to facilitate the threading of stud 17 into bore 18 or the unthreading of members 15, 16 from each other.

Stem 26, whose diameter equals those of guide bore 20 and hole 32, is surrounded by a coil spring 29 which bears upon the bottom 30 of recess 25 and upon the inner face 31 of head 33. In the normal position illustrated in FIG. 2, spring 29 holds the slotted outer surface of head 33 flush with that of cheek 24 while the corresponding surface 39 of detent 15 is flush with the outer surface of cheek 22. In this position, a diametrically extending ridge or key 19 of detent 15 engages with close fit in a substantially rectangular slot 21 of blade 12 bisected by its hole 32, the free edge of that ridge coming to rest on the bottom 14 of slot 21 even as the inner detent surface 23 flanking that ridge bears upon the confronting blade surface which forms the bottom of cutout 27. With the spacing of that blade surface from the bottom 30 of recess 25 substantially less than the axial separation of surfaces 23 and 31, the control unit constituted by members 15 and 16 is axially shiftable (to the right in FIG. 2) into an off-normal position against the force of spring 29. In that off-normal position, determined by the compressibility of the spring, detent 15 still extends into cutout 27 while its ridge 19 clears the slot 21 of blade 12 so that the latter can be freely swung through 180° between its illustrated extended position and a retracted position within pocket 13. In either of these limiting positions, the engagement of ridge 19 with slot 21 holds the blade in place relative to handle 11; in the extended position, this interengagement also transmits the force of the user's hand to the cutting edge of the blade.

If desired, the embodiment of FIGS. 1–5 could be modified by letting the slot 21 completely penetrate the blade 12; in that instance the normal position of the control unit will still be defined by contact between the detent surface 23 and the blade. It is also possible to replace the coil spring 29 by some other resilient element, e.g. an annular leaf spring.

In FIGS. 6–11, in which elements corresponding to those of FIGS. 1–5 have been given the same reference numerals supplemented by a prime mark, the cutout of cheek 22' is a recess 27' communicating with pocket 13' through a reduced guide bore 20'. The blunt end of blade 12' has a hole 37 whose diameter equals that of bore 20' but is smaller than that of a bore 55 in a flange 54 of cheek 24' forming an extension of recess 25'. The plunger 16' of this embodiment has a head 33' provided with preferably four holes 38 (only two shown) which facilitate its engagement by a pronged tool to establish a rigid connection between the plunger and the detent 15', by the engagement of a threaded end of its stem 26' with a complementarily threaded bore 34 of the detent, or a detachment of the plunger from the detent for enabling a replacement of blade 12'. Plunger head 33' has a neck 49, of larger diameter than stem 26', forming a seat for biasing spring 29' which in this instance extends through bore 55 into direct contact with the confronting surface of blade 12'.

Detent 15' has a lug 36 projecting from its periphery, thus at a location remote from pivotal axis O, through an aperture 57 of cheek 22' and terminates in a beveled tip of generally trapezoidal shape with flanks 47 and 48 normally protruding into pocket 13'. Two peripheral notches **35*a* and 35*b* at the blunt end of blade 12' are aligned with lug 36 in the extended position of FIGS. 6, 8, 9 and in the retracted position of FIG. 7, respectively. These notches are bisected by a diameter 40, FIG. 6, which includes with the longitudinal direction 52 of the blade an angle of at least 45°. Notches 35*a* and 35*b* have flanks 41, 42 terminating in respective humps 43, 44 which come to rest against shoulders 45, 46 of handle 11' in the extended and the retracted blade position, respectively, in which the tip of lug 36 is urged into engagement with the aligned notch by the force of biasing spring 29'. The blade 12' is therefore securely indexed in each of these positions with reference to handle 11'. If desired, the blade could also be provided with a third notch confronting the lug 36** in an intermediate position in which the blade can be indexed at an obtuse angle to its handle, e.g. for the purpose of skinning an animal.

Figure 10:
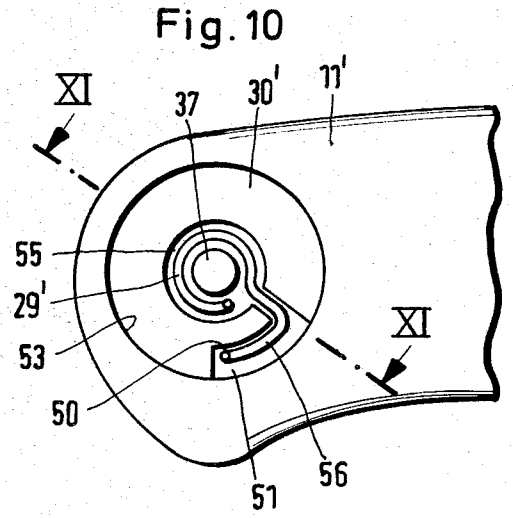
FIG. 10 is a fragmentary end view of the knife of FIG. 6, as seen in the direction X of FIG. 8 but with its plunger removed.
Figure 11:
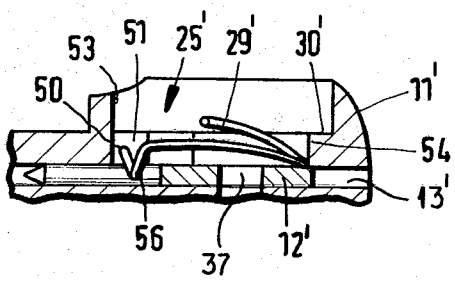
FIG. 11 is a cross-sectional view taken on the line XI—XI of FIG. 10.

As illustrated in FIGS. 10 and 11, spring 29' has an extremity 56 which is deflected radially outward into a channel 51 extending from bore 55 flush with part of the peripheral wall 53 of recess 25'. Extremity 56 forms an elbow which bears under axial pressure upon the proximal surface of blade 12' to retard its swing for the reason discussed above, i.e. to prevent the use of the knife as an offensive weapon and to minimize the risk of accidents. In an intermediate position, determined by the aforementioned angle between diameter 40 and direction 52, notch **35*b* passes the bent spring extremity 56 which partly enters that notch for a more positive retardation; the free end 50 of this extremity, however, always remains outside pocket 13'** so that the blade can be readily swung back and forth.

Figures 2, 3, 4, 5:
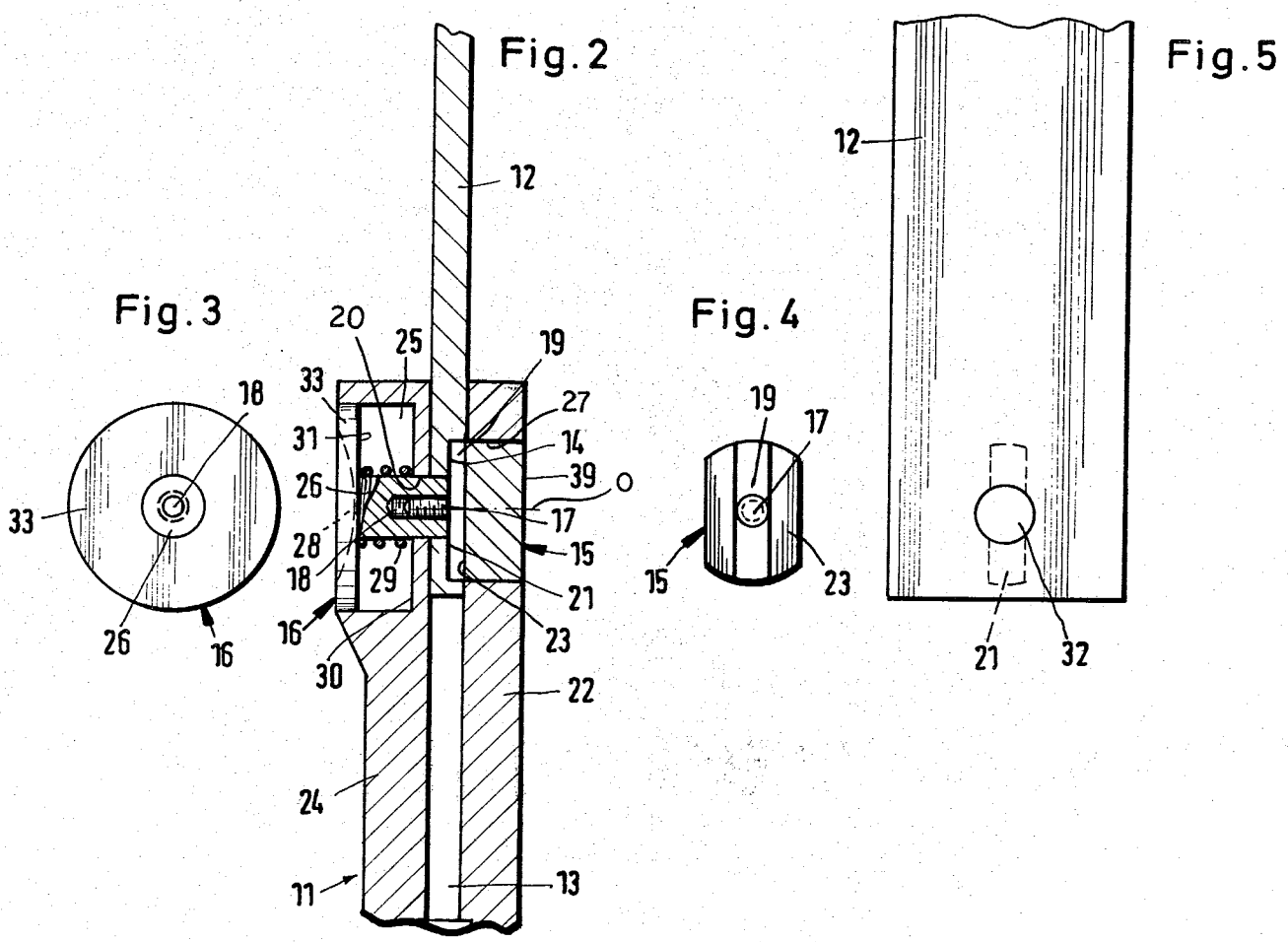
FIG. 2 is a fragmentary sectional view taken on the line II—II of FIG. 1 and drawn to a larger scale.
FIG. 3 is a face view of a plunger lodged in the knife handle, as seen from inside that handle.
FIG. 4 is a face view of a detent also lodged in the knife handle on the side opposite the plunger, again as seen from inside that handle.
FIG. 5 is a fragmentary side view of the blade, showing its blunt end.
Figure 7:
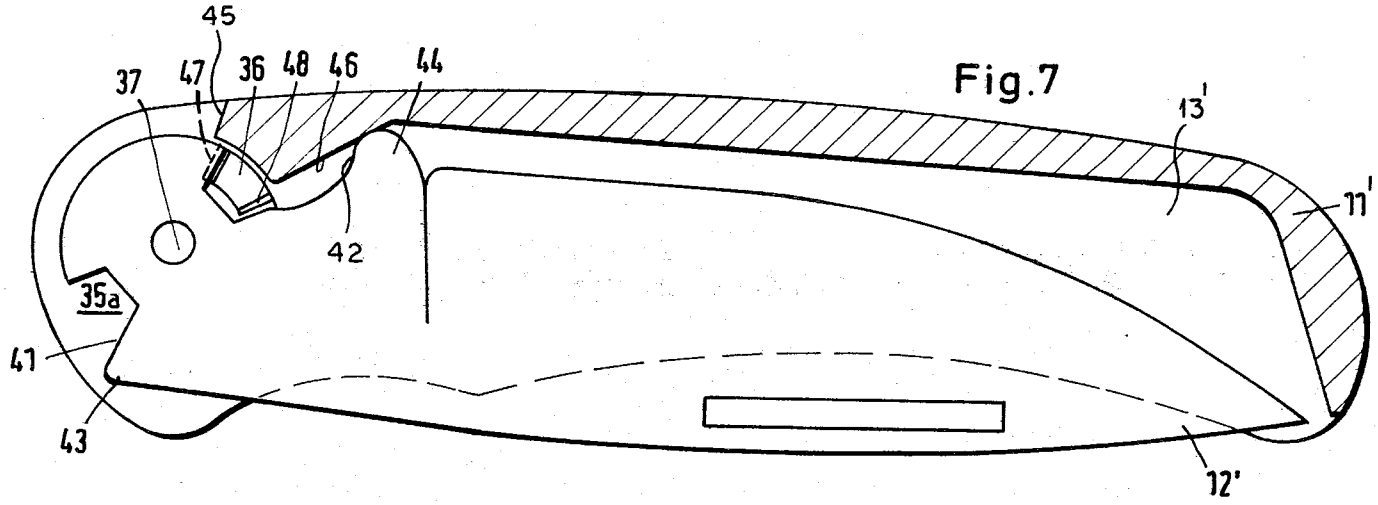
FIG. 7 is a longitudinal sectional view of the knife of FIG. 6 with its blade retracted.
Figure 9:
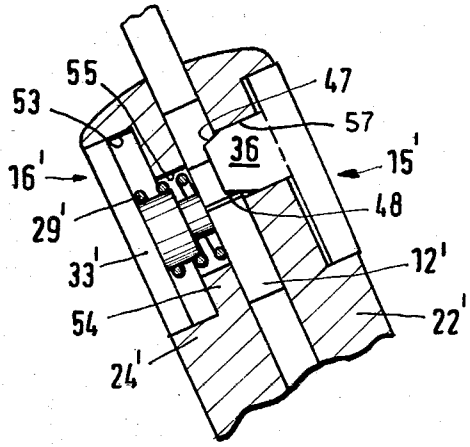
FIGS. 8 and 9 are cross-sectional views respectively taken on lines VIII—VIII and IX—IX of FIG. 6.
Figure 6:
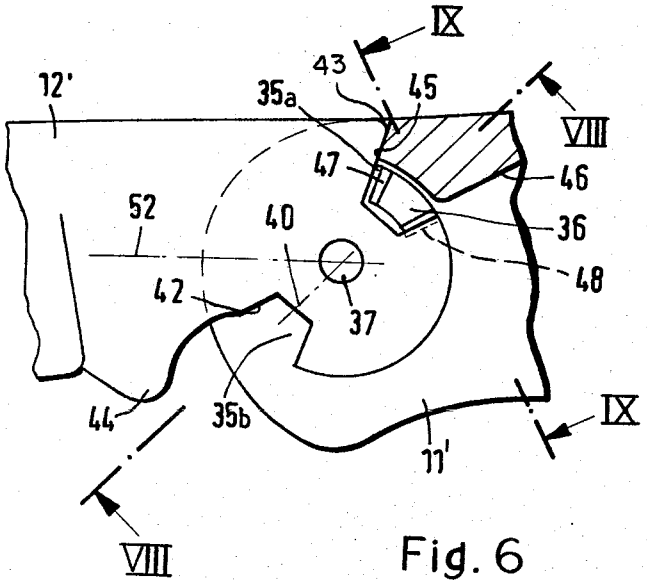
FIG. 6 is a fragmentary side view of a more elaborate knife according to my invention in the extended position of its blade, with parts of the blade and the handle broken away.
Figure 8:
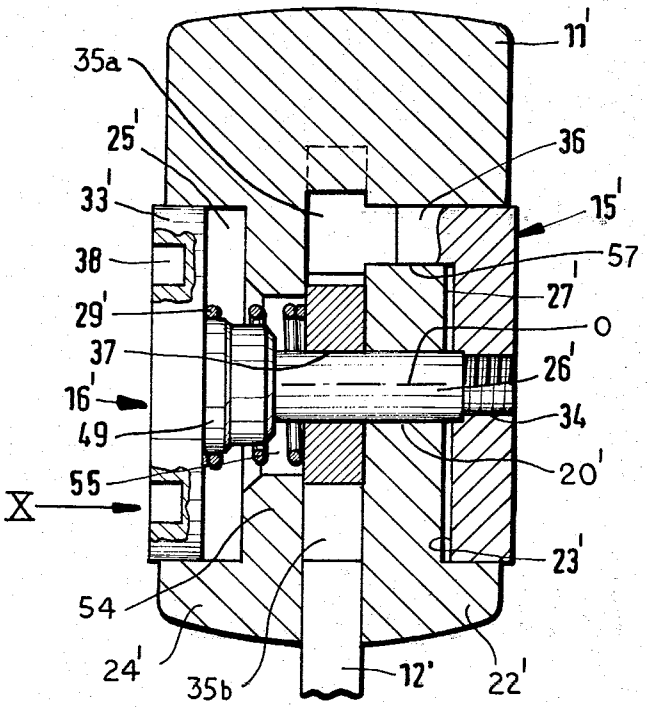

From FIG. 8 it will be noted that the outer surfaces of members 15' and 16' are not exactly flush with the corresponding cheek surfaces, as illustrated in FIG. 2 for the embodiment first described, and that a small gap exists between the bottom of recess 27' and detent surface 23' in the normal position in which the tip of lug 36 engages one of the notches **35*a*, 35*b* of blade 12'. This gap provides the necessary play for a firm engagement between the detent and the blade in the presence of unavoidable tolerances. Lug 36, whose great distance from axis O is a further stabilizing factor, can be machined from an annular flange integral with detent 15'** which is cut away over the major part of its periphery.

I claim:

1. A folding knife comprising:

a blade with a longitudinal cutting edge ending in a point and a blunt end opposite said point provided with a circular hole;

a handle having a body integrally formed with substantially coextensive first and second cheeks separated by a pocket accommodating said blade in a retracted position of the latter, said first and second cheeks being provided with aligned first and second cutouts extending in line with said hole from said pocket to the outer cheek surfaces;

a first and second member respectively lodged in said first and second cutouts and rigidly interconnected by a stem of the same diameter as said hole forming part of one of said members and traversing said hole, said members being separated by a distance sufficient to enable their joint displacement along the axis of said bore between a normal and an off-normal position; and spring means engaging said first member in said first cutout for biasing said members into said normal position, said second member being nonrotatable about said axis and being provided with a retaining formation engaging a coacting formation on said blunt end in the retracted position and in an extended position of said blade, axial depression of said first member against the force of said spring means disengaging said formations for enabling a pivoting of said blade about said axis.

2. A folding knife as defined in claim 1 wherein said spring means comprises a resilient element in said first recess with an extremity bearing upon said blade and retarding the pivoted displacement thereof between said retracted and extended positions.

3. A folding knife as defined in claim 2 wherein said coacting formation is a pair of notches on the periphery of said blunt end, one of said notches confronting said extremity in an intermediate position of said blade and being engageable by said extremity to retard the blade motion.

4. A folding knife as defined in claim 2 or 3 wherein said resilient element is a coil spring surrounding said stem.

5. A folding knife as defined in claim 1, 2 or 3 wherein cutout one of said cutouts forms a recess communicating with said pocket though a reduced bore of the same diameter as said stem and said hole.

6. A folding knife as defined in claim 1, 2 or 3 wherein said retaining formation is a radially extending ridge, said coacting formation being a slot perpendicular to said axis accommodating said ridge in said normal position.

7. A folding knife as defined in claim 6 wherein said slot has a depth less than the thickness of said blade and forms an abutment for said ridge limiting the axial displacement of said members by said spring means.

8. A folding knife as defined in claim 1 wherein said retaining formation comprises an off-axial projection on said second member penetrating an aperture in said second cheek and normally reaching into said pocket, said coacting formation being a pair of diametrically opposite peripheral notches on said blunt end respectively aligned with said cutout in said retracted and extended positions of said blade.

9. A folding knife as defined in claim 8 wherein said projection has a beveled tip fitting between diverging flanks of a notch aligned therewith.

10. A folding knife as defined in claim 3 or 8 wherein said notches are bisected by a diameter including an angle of at least 45° with the longitudinal direction of said blade.

11. A folding knife as defined in claim 1, 2 or 3 wherein said blade is provided with angularly spaced humps coming to rest against shoulders of said handle in said retracted and extended positions.

* * * * *